US010227192B2

(12) United States Patent
Tatematsu

(10) Patent No.: US 10,227,192 B2
(45) Date of Patent: Mar. 12, 2019

(54) IMAGE FORMING APPARATUS

(71) Applicant: Brother Kogyo Kabushiki Kaisha, Nagoya-shi, Aichi-ken (JP)

(72) Inventor: Hirotaka Tatematsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/920,719

(22) Filed: Mar. 14, 2018

(65) Prior Publication Data

US 2018/0273326 A1 Sep. 27, 2018

(30) Foreign Application Priority Data

Mar. 24, 2017 (JP) ..... 2017-059379

(51) Int. Cl.

| | |
|---|---|
| ***B65H 1/26*** | (2006.01) |
| ***B65H 9/12*** | (2006.01) |
| ***B65H 3/66*** | (2006.01) |
| ***B65H 5/36*** | (2006.01) |

(52) U.S. Cl.

CPC ..... *B65H 1/266* (2013.01); *B65H 3/66* (2013.01); *B65H 5/36* (2013.01); *B65H 9/12* (2013.01); *B65H 2405/121* (2013.01); *B65H 2405/31* (2013.01)

(58) Field of Classification Search

CPC . B65H 1/26; B65H 1/266; B65H 3/66; B65H 5/36; B65H 2404/63; B65H 2405/12; B65H 2405/121; B65H 2405/31

See application file for complete search history.

(56) References Cited

U.S. PATENT DOCUMENTS

| | | | | |
|---|---|---|---|---|
| 5,078,382 A * | 1/1992 | Tanjo | ..... | B65H 1/04 221/153 |
| 5,155,537 A * | 10/1992 | Komatsu | ..... | B65H 1/04 271/9.02 |
| 7,775,516 B2 | 8/2010 | Miwa | | |
| 8,322,716 B2 | 12/2012 | Miwa | | |
| 2009/0001660 A1 | 1/2009 | Miwa | | |

(Continued)

FOREIGN PATENT DOCUMENTS

| | | |
|---|---|---|
| JP | H06-247569 A | 9/1994 |
| JP | 2009-007123 A | 1/2009 |

(Continued)

*Primary Examiner* — Prasad V Gokhale

(74) *Attorney, Agent, or Firm* — Banner & Witcoff, Ltd.

(57) ABSTRACT

An image forming apparatus including: a sheet feeding tray configured to support a sheet; and an apparatus main body configured to support the sheet feeding tray so as to be moveable in a direction parallel with a sheet feeding direction, the apparatus main body including a chute configured to guide the sheet that is fed from the sheet feeding tray, wherein the sheet feeding tray includes a guiding member configured to be displaced between an engaging position at which the guiding member engages with the chute and restrains movement of the sheet feeding tray and a separation position at which the guiding member separates from the chute and permits movement of the sheet feeding tray, and wherein the guiding member is configured to guide the sheet that is fed from the sheet feeding tray toward the chute when the guiding member is located at the engaging position.

7 Claims, 8 Drawing Sheets

(56) References Cited

U.S. PATENT DOCUMENTS

| | | | | |
|---|---|---|---|---|
| 2010/0270727 | A1 | 10/2010 | Miwa | |
| 2013/0009359 | A1* | 1/2013 | Yamada | G03G 15/6502 271/264 |
| 2017/0057767 | A1* | 3/2017 | Ishida et al. | B65H 5/38 |

FOREIGN PATENT DOCUMENTS

| | | | |
|---|---|---|---|
| JP | 2010-143739 | A | 7/2010 |
| JP | 2010-202381 | A | 9/2010 |
| JP | 2016-016987 | A | 2/2016 |

* cited by examiner

IMAGE FORMING APPARATUS

CROSS-REFERENCE TO RELATED APPLICATIONS

This application claims priority from Japanese Patent Application No. 2017-059379 filed on Mar. 24, 2017, the entire contents of which are incorporated herein by reference.

TECHNICAL FIELD

The disclosure relates to a technology of an image forming apparatus.

BACKGROUND

In related art, an image forming apparatus has been known which includes a sheet feeding tray configured to support a sheet, and an apparatus main body configured to support the sheet feeding tray so as to be moveable in a conveying direction of the sheet.

Regarding the image forming apparatus, for example, an image forming apparatus has been known which includes conveying rollers (a feeder roller, a separation roller, and the like) configured to convey a sheet and a chute provided downstream of the conveying rollers with respect to a conveying direction of the sheet, and a sheet conveyance path configured by the chute has a curved shape.

Here, in the image forming apparatus, since the sheet feeding tray is moveably supported by the apparatus main body, the chute for guiding the sheet has such a configuration where it is divided into a first chute provided to the sheet feeding tray-side and a second chute provided to the apparatus main body-side.

Therefore, when conveying the sheet from a sheet conveyance path of the sheet feeding tray-side to a sheet conveyance path of the apparatus main body-side, it is necessary to provide a step (hereinafter, referred to as "step portion") between the first chute and the second chute and to receive the sheet at the second chute of the apparatus main body-side so as to prevent a front end of the sheet from being jammed at a boundary part between the first chute and the second chute.

For that reason, when a stiff thick sheet is used, for example, immediately after a rear end of the sheet with respect to the conveying direction passes through the step portion, the sheet hops up and collides with the second chute of the apparatus main body-side due to an elastic force of the sheet, so that a hopping sound is caused.

Therefore, according to the related art, in order to suppress the hopping sound at the step portion, the step portion of the chute is configured so that it is inclined toward a downstream side of the conveying direction as it is directed from both end portions of the sheet in a width direction toward a central portion in the width direction, and when a rear end of the sheet in the conveying direction passes through the step portion, the sheet gradually moves to the second chute of the apparatus main body-side from both end portions of the sheet in the width direction toward the central portion in the width direction.

However, even with the above configuration, when the sheet conveyance path is curved, the elastic force, which is generated on the sheet being guided, is high. Therefore, when the central portion, in the width direction, of the rear end of the sheet in the conveying direction passes through the step portion and the sheet moves to the second chute of the apparatus main body-side, the rear end of the sheet hops up and collides with the second chute, so that the hopping sound may be generated.

SUMMARY

The disclosure has been made in view of the above situations, and an object thereof is to provide an image forming apparatus capable of suppressing a hopping sound of a sheet.

According to an aspect of the disclosure, there is provided an image forming apparatus including: a sheet feeding tray configured to support a sheet that is to be fed; and an apparatus main body configured to support the sheet feeding tray so as to be moveable in a direction parallel with a sheet feeding direction of the sheet, the apparatus main body including a chute configured to guide the sheet that is fed from the sheet feeding tray, wherein the sheet feeding tray includes a guiding member configured to be displaced between an engaging position at which the guiding member engages with the chute and restrains movement of the sheet feeding tray and a separation position at which the guiding member separates from the chute and permits movement of the sheet feeding tray, and wherein the guiding member is configured to guide the sheet that is fed from the sheet feeding tray toward the chute when the guiding member is located at the engaging position.

According to the disclosure, it is possible to suppress the hopping sound of the sheet in the image forming apparatus.

DETAILED DESCRIPTION

Hereinafter, an illustrative embodiment of the disclosure will be described with reference to the accompanying drawings.

<Overall Configuration of Image Forming Apparatus 1>

Figure 1:
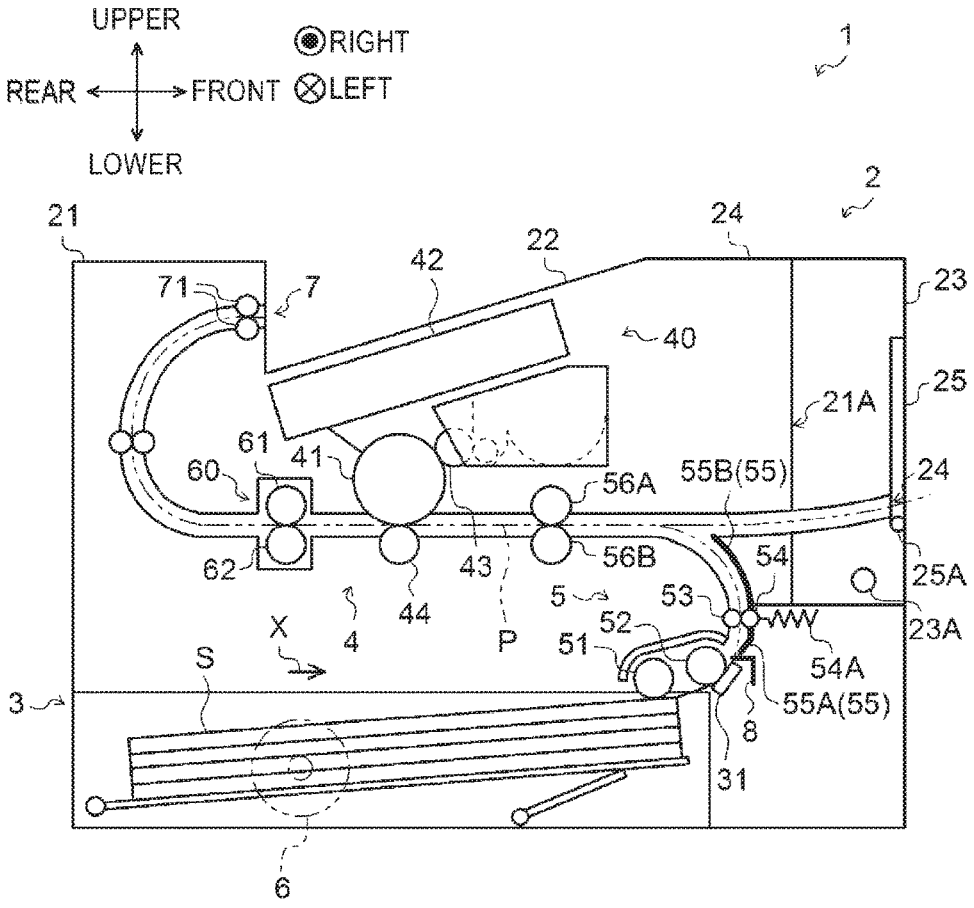
FIG. 1 is a central sectional view depicting an image forming apparatus.
Figure 2:
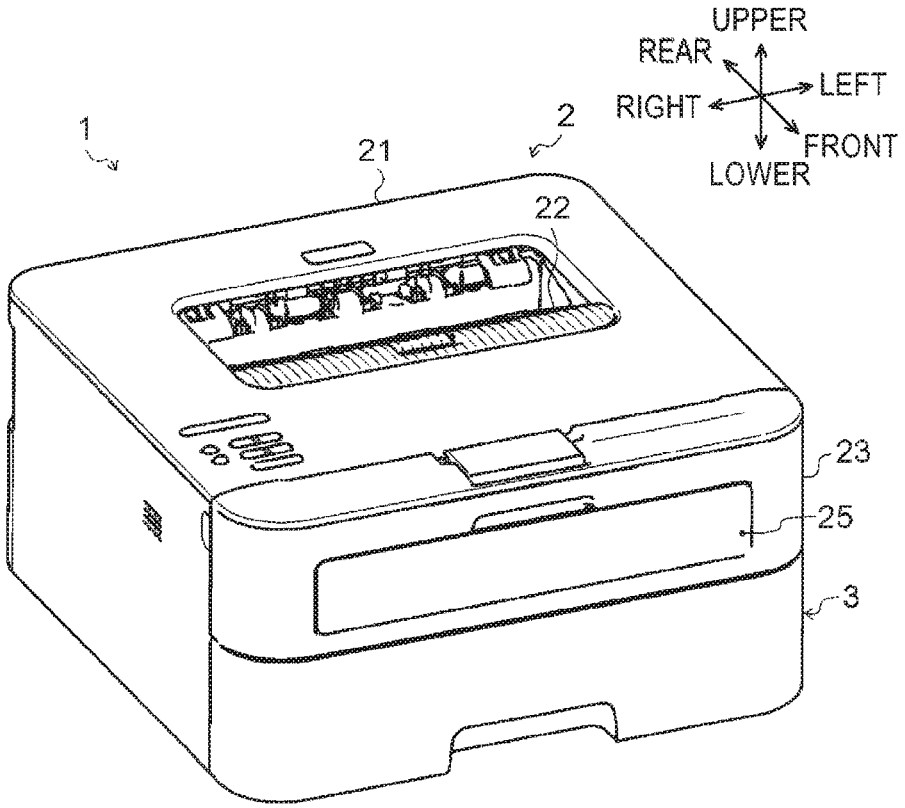
FIG. 2 is a perspective view depicting the image forming apparatus in which a sheet feeding tray is inserted.
Figure 3:
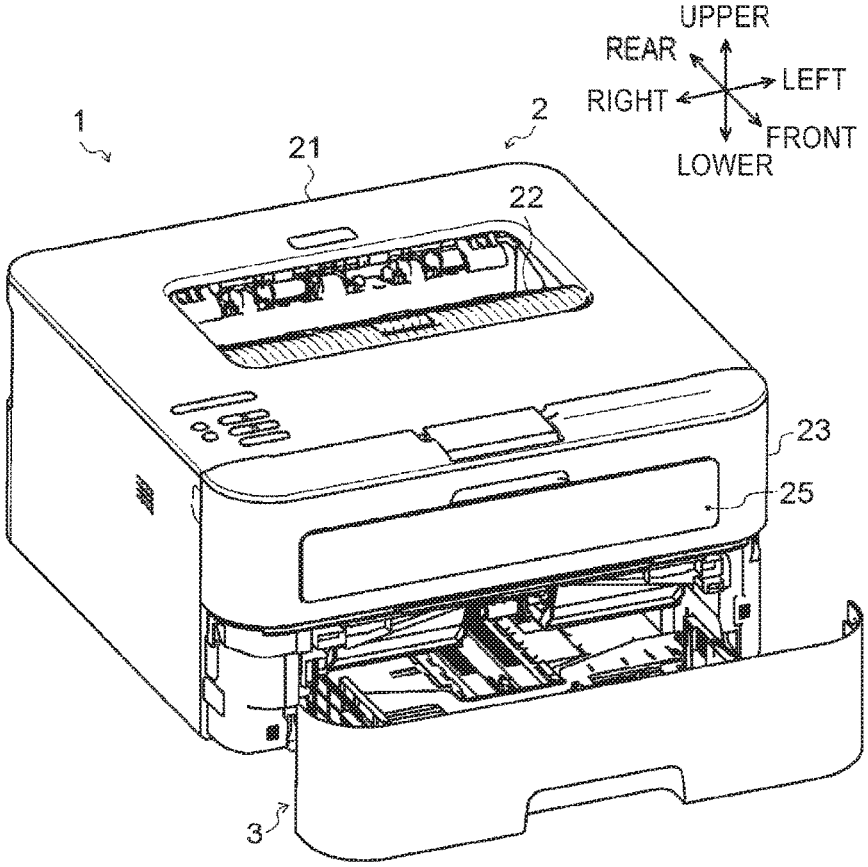
FIG. 3 is a perspective view depicting the image forming apparatus from which the sheet feeding tray is pulled out.

An image forming apparatus 1 shown in FIGS. 1 to 3 is an illustrative embodiment of the image forming apparatus of the disclosure, and includes an apparatus main body 2, and a sheet feeding tray 3 provided at a lower part of the apparatus main body 2. Also, the apparatus main body 2 has a housing 21 having a substantially cubic shape. In the housing 21, there is provided an image forming unit 4 configured to form an image on a sheet S, a feeder unit 5 configured to feed the sheet S from the sheet feeding tray 3 to the image forming unit 4, a motor 6 which is an example of a driving source configured to drive the image forming unit 4, and the like.

In the following descriptions, a right side in FIG. 1 is defined as the front side of the image forming apparatus 1, a left side in FIG. 1 is defined as the rear side of the image forming apparatus 1, a front side of the drawing sheet of FIG. 1 is defined as the right side of the image forming apparatus 1, and a back side of the drawing sheet of FIG. 1 is defined as the left side of the image forming apparatus 1. Also, a top and bottom direction in FIG. 1 is defined as the upper and lower direction of the image forming apparatus 1.

A front face of the housing 21 is formed with an opening 21A. Also, an upper surface of the housing 21 is formed with a sheet discharge tray 22 recessed so as to be inclined downward from the front side toward the rear side.

The housing 21 has the image forming unit 4 and the feeder unit 5 accommodated therein.

The apparatus main body 2 has a front cover 23 that can open and close the opening 21A. The front cover 23 is configured to be rotatable about a rotational shaft 23A at a lower end portion thereof. When the front cover is rotated about the rotational shaft 23A, it can be displaced between a closed position at which the opening 21A is closed and an opened position at which the opening 21A is opened.

The front cover 23 has a manual feed slot 24 in which the sheet S can be manually inserted, and a manual feed slot cover 25 that can open and close the manual feed slot 24. The manual feed slot cover 25 is configured to be rotatable about a rotational shaft 25A of a lower end portion thereof. When the manual feed slot cover is rotated about the rotational shaft 25A, it can be displaced between a closed position at which the manual feed slot 24 is closed and an opened position at which the manual feed slot 24 is opened.

The feeder unit 5 includes a feeder roller 51, a separation roller 52, a paper dust removal roller 53, a pressing roller 54, a chute 55, and a pair of register rollers 56A, 56B.

In the meantime, the paper dust removal roller 53 and the pressing roller 54 are disposed in parallel with each other. Also, the pressing roller 54 is always urged toward the paper dust removal roller 53 by an urging means 54A, so that it is press-contacted at an outer peripheral surface to the paper dust removal roller 53.

In the apparatus main body 2 (more specifically, the housing 21), a conveyance path P reaching the sheet discharge tray 22 from the sheet feeding tray 3 via the image forming unit 4 is configured, and the sheet S that is supported by the sheet feeding tray 3 is fed to the conveyance path P by the feeder unit 5.

Herein, the sheet feeding tray 3 can support a plurality of stacked sheets S, which are to be fed to the conveyance path P, and has a separation pad 31 for separating and feeding the plurality of sheets S one by one. In the meantime, the separation pad 31 is an example of the friction member. However, the friction member is not limited to the separation pad. For example, a so-called retard roller or the like can also be utilized.

Also, as shown in FIG. 3, the sheet feeding tray 3 is supported by the lower part of the housing 21 of the apparatus main body 2 so that it can be pulled out (moved) in a direction parallel with a sheet feeding direction of the sheet S (i.e., in the illustrative embodiment, a direction of an arrow X (refer to FIG. 1) directed from the rear toward the front).

As shown in FIG. 1, the apparatus main body 2 includes the feeder roller 51 configured to feed the sheet S supported by the sheet feeding tray 3, and the separation roller 52 disposed at a more downstream side of the feeder roller 51 than the feeder roller 51 with respect to the sheet feeding direction and configured to form a nip point together with the separation pad 31.

Also, the apparatus main body 2 includes the chute 55 configured to guide the sheet S fed from the sheet feeding tray 3 and having passed through the nip point, and the paper dust removal roller 53 and the pressing roller 54, and the pair of register rollers 56A, 56B, which are disposed in corresponding order at the downstream side of the chute 55 with respect to the sheet feeding direction.

In the feeder unit 5 configured as described above, the sheets S accommodated in the sheet feeding tray 3 are sent toward the separation roller 52 by the feeder roller 51, and are separated one by one by the separation roller 52 and the separation pad 31. The separated sheet is fed toward the conveyance path P.

The sheet S fed from the separation roller 52 and the separation pad 31 passes through the paper dust removal roller 53 and the pressing roller 54 while being guided upward along the curved chute 55, and is then conveyed toward the image forming unit 4 by the pair of register rollers 56A, 56B disposed at a more downstream side of the conveyance path P than the paper dust removal roller 53 and the pressing roller 54 with respect to the sheet feeding direction. The pair of register rollers 56A, 56B restrains movement of a tip end of the sheet S being conveyed so as to stop the sheet S, and then conveys the sheet S toward a transfer position of the image forming unit 4 at a predetermined timing.

The image forming unit 4 is disposed above the sheet feeding tray 3, and includes a process cartridge 40 configured to transfer an image to a surface of the sheet S conveyed from the feeder unit 5, an exposure unit 42 configured to expose a surface of a photosensitive drum 41 of the process cartridge 40, and a fixing unit 60 configured to fix the image transferred to the sheet S by the process cartridge 40.

The process cartridge 40 includes a developing roller 43, a photosensitive drum 41, a transfer roller 44, and the like.

The exposure unit 42 includes a laser diode, a polygon mirror, a lens, a reflector and the like, and is configured to illuminate laser light toward the photosensitive drum 41 on the basis of image data input to the image forming apparatus 1, thereby exposing the surface of the photosensitive drum 41.

The photosensitive drum 41 is disposed to be adjacent to the developing roller 43. The surface of the photosensitive drum 41 is uniformly positively-charged by a charger (not shown), and is then exposed by the exposure unit 42. The exposed part of the photosensitive drum 41 has a lower potential than the other part, and an electrostatic latent image based on the image data is formed on the photosensitive drum 41.

The surface of the photosensitive drum 41 having the electrostatic latent image formed thereon is supplied with positively charged toner from the developing roller 43, so that the electrostatic latent image is visualized and becomes a developer image.

The transfer roller 44 is disposed to face the photosensitive drum 41, and is applied with a negative transfer bias by a bias applying means (not shown). At a state where the surface of the transfer roller 44 is applied with the transfer bias, the sheet S is conveyed with being sandwiched (to a transfer position) between the photosensitive drum 41 having the developer image formed thereon and the transfer roller 44, so that the developer image formed on the surface of the photosensitive drum 41 is transferred to a surface of the sheet S.

The fixing unit 60 includes a heating roller 61 and a pressing roller 62. The heating roller 61 is configured to rotatively drive by a driving force from the motor 6, and the heating roller 61 is heated by power fed from a power supply (not shown). The pressing roller 62 is disposed to face the heating roller 61, and is configured to be driven and rotated with being in close contact with the heating roller 61. When the sheet S having the developer image transferred thereto is transferred to the fixing unit 60, the sheet S is conveyed with being sandwiched between the heating roller 61 and the pressing roller 62, and the developer image is fixed to the sheet S.

A discharge unit 7 includes a pair of discharge rollers 71, 71, and is configured to discharge the sheet S conveyed from the fixing unit 60 toward an outside of the housing 21. Specifically, the sheet S conveyed from the fixing unit 60 is discharged to the sheet discharge tray 22 by the pair of discharge rollers 71, 71.

<Configuration of Chute 55>

Subsequently, a configuration of the chute 55 is described with reference to FIGS. 4 and 5.

The chute 55 is mainly disposed at a more downstream side of the apparatus main body 2 than the separation roller 52 (refer to FIG. 1) with respect to the sheet feeding direction of the sheet S. As described above, the chute 55 is provided as a guiding member for guiding the sheet S sent from the sheet feeding tray 3 toward the conveyance path P (refer to FIG. 1).

The chute 55 is divided into a first chute 55A provided to the sheet feeding tray 3-side and a second chute 55B provided to the apparatus main body 2-side.

Figure 4:
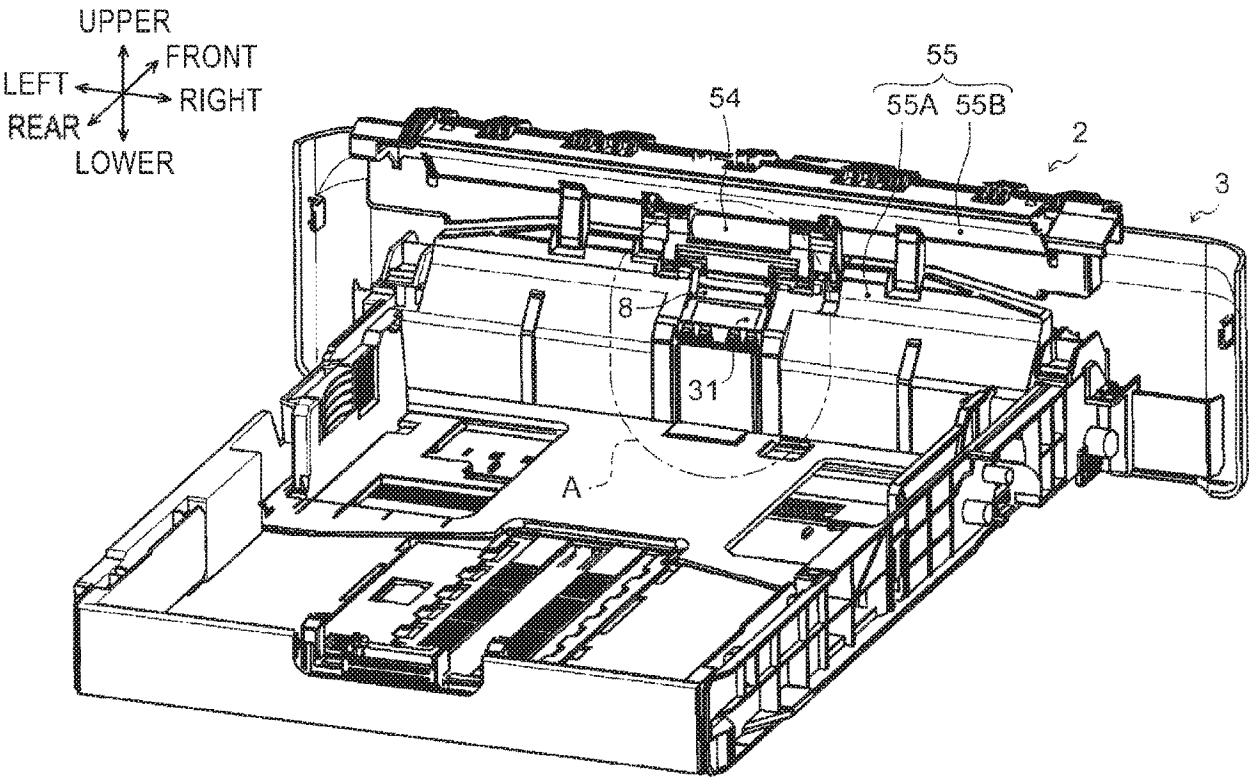
FIG. 4 is a perspective view depicting an entire configuration of the sheet feeding tray, as seen from an apparatus main body.

The first chute 55A is disposed at a more downstream side than the separation pad 31 with respect to the sheet feeding direction of the sheet S, and is formed so that a width size thereof in a width direction (a right and left direction in FIG. 4) gradually decreases toward the downstream side (an upper side in FIG. 4).

Also, the first chute 55A is inclined upward with being substantially curved toward the downstream side with respect to the sheet feeding direction of the sheet S.

In this way, the first chute 55A is symmetric with respect to the width direction (the right and left direction) perpendicular to the sheet feeding direction of the sheet S, and has a substantially mountain shape.

The second chute 55B is disposed at a more downstream side of the apparatus main body 2 than the first chute 55A with respect to the sheet feeding direction of the sheet S. Also, the second chute 55B configures a part of the conveyance path P (refer to FIG. 1) of the sheet S, and is positioned at the most upstream side of the conveyance path P of the sheet S in the apparatus main body 2.

A lower end portion (i.e., an upstream end portion with respect to the sheet feeding direction of the sheet S) of the second chute 55B is formed in conformity to a shape of an upper end portion (i.e., a downstream end portion with respect to the sheet feeding direction of the sheet S) of the first chute 55A.

Also, the pressing roller 54 is disposed at a central portion of the lower end portion of the second chute 55B in the width direction (the right and left direction) perpendicular to the sheet feeding direction of the sheet S.

A guiding member 8 provided to the sheet feeding tray 3 is disposed to protrude toward the rear (i.e., toward a locus of the sheet S to be fed) between the pressing roller 54 and the separation pad 31.

<Guiding Member 8>

Hereinafter, a configuration of the guiding member 8 is described with reference to FIGS. 5 to 8.

The guiding member 8 is to guide the sheet S, which is to be fed from the sheet feeding tray 3, toward the second chute 55B, which is the chute 55 of the apparatus main body 2-side, and to restrain the sheet feeding tray 3 from moving relative to the apparatus main body 2.

Figure 6:
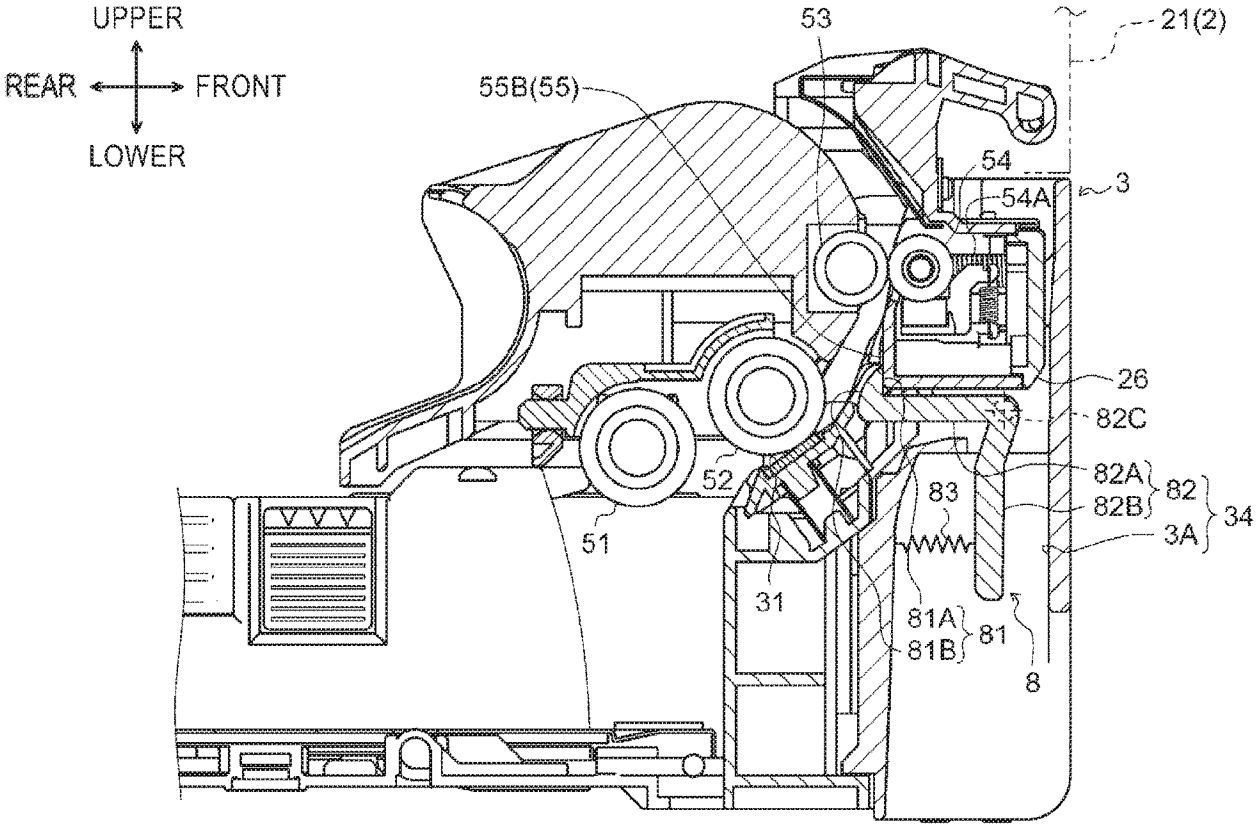
FIG. 6 depicts the sheet feeding tray inserted in the apparatus main body, and is an enlarged sectional view depicting the vicinity of the guiding member displaced to an engaging position.
Figure 7:
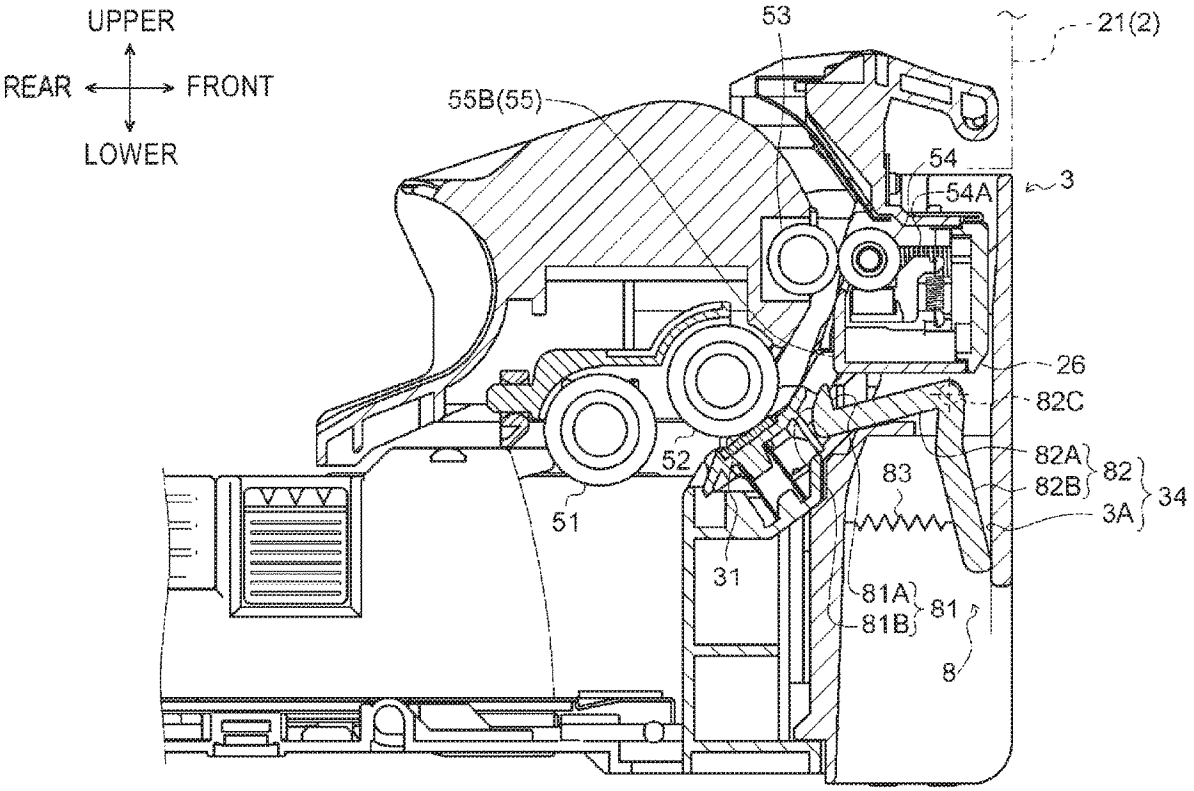
FIG. 7 depicts the sheet feeding tray inserted in the apparatus main body, and is an enlarged sectional view depicting the vicinity of the guiding member displaced to a separation position.
Figure 8:
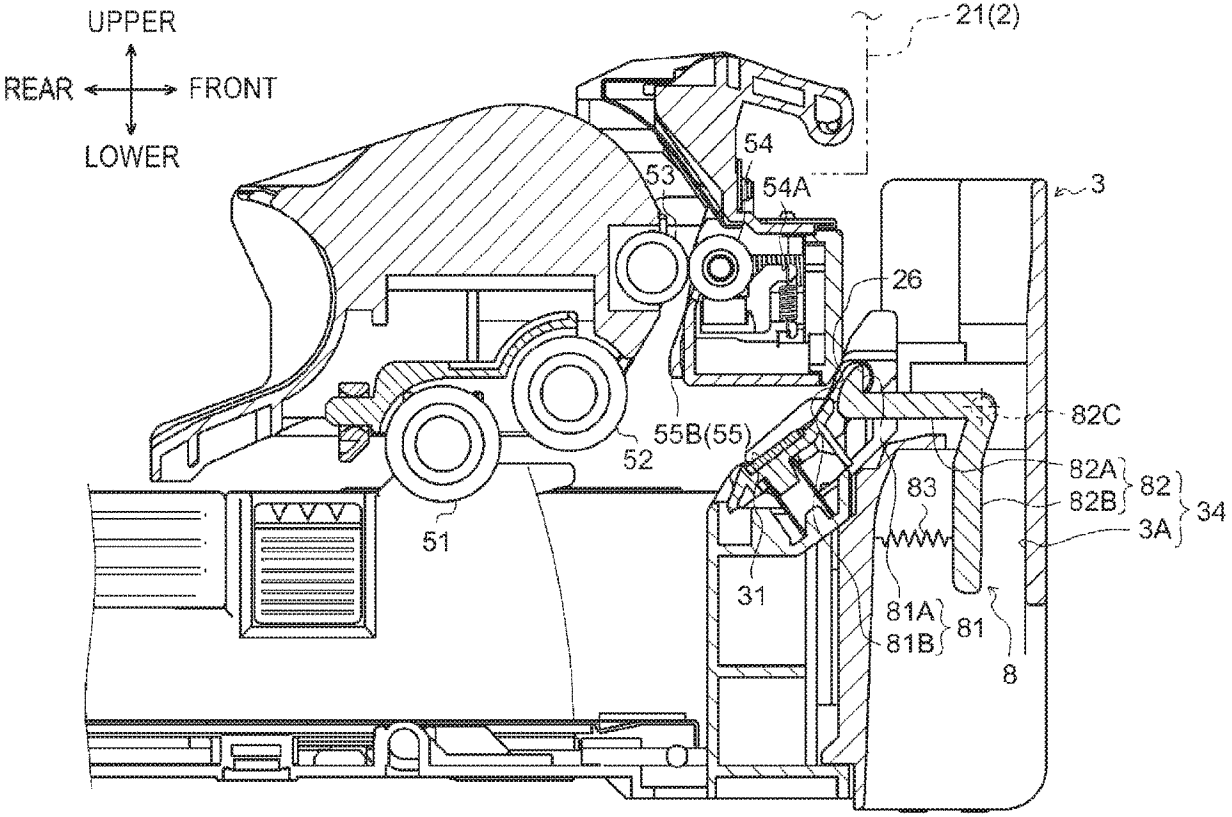
FIG. 8 depicts the sheet feeding tray pulled out from the apparatus main body, and is an enlarged sectional view depicting the vicinity of the guiding member displaced to the engaging position.

As shown in FIGS. 6 to 8, the guiding member 8 is mainly configured by an engaging part 81, which is a base part of the guiding member 8 and is configured to engage with the chute 55 (more specifically, the second chute 55B), and a coupling part 82 for operating the engaging part 81.

The engaging part 81 has a substantially rectangular plate shape, extends in the right and left direction (the width direction of the sheet S to be fed) between the separation pad 31 and the lower end portion of the second chute 55B, and is disposed so that both front and rear side surfaces face the front and rear direction (the moving direction of the sheet feeding tray 3).

Figure 5:
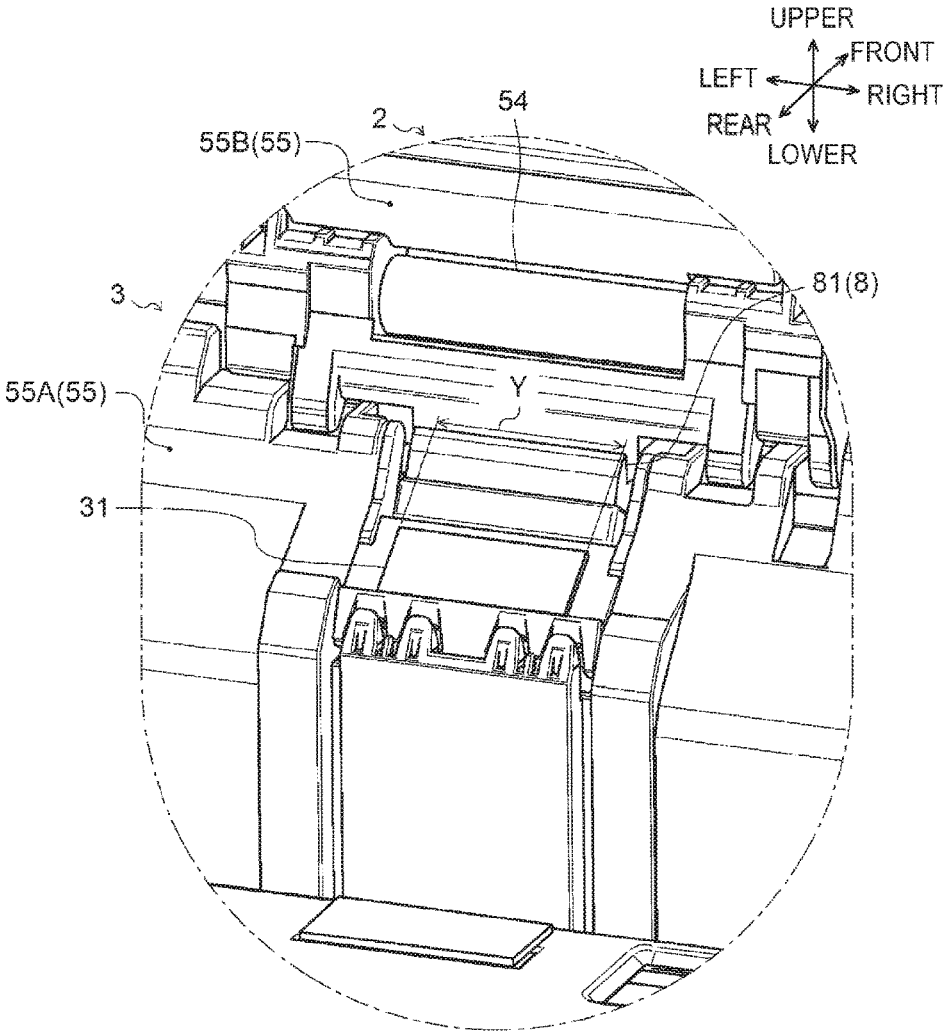
FIG. 5 is an enlarged perspective view of a region A in FIG. 4, depicting a vicinity of a guiding member of the sheet feeding tray.

Also, as shown in FIG. 5, the engaging part 81 of the guiding member 8 is disposed downstream of the separation pad 31 with respect to the sheet feeding direction of the sheet S and is disposed so as to at least entirely overlap a region (a region Y in FIG. 5) in the right and left direction (i.e., the direction perpendicular to the sheet feeding direction) in which the separation pad 31 is provided.

By the above configuration, for example, even when the step portion of the chute 55 is configured so that it is inclined toward the downstream side of the sheet feeding direction as it is directed from both end portions of the sheet S in the width direction (the right and left direction) toward the central portion in the width direction, as disclosed in the related art, it is possible to further securely suppress the hopping sound that occurs when the rear end of the sheet S passes through the step portion.

A rear side surface of the engaging part 81 is formed as an engaging surface 81A that comes into contact with the lower end portion of the second chute 55B, and a front side surface of the engaging part 81, i.e., an opposite surface to the engaging surface 81A is formed as a guide surface 81B configured to guide the sheet S that is fed from the sheet feeding tray 3. That is, in the engaging part 81, the engaging surface 81A configured to engage with the lower end portion of the second chute 55B and the guide surface 81B configured to guide the sheet S are disposed in different regions (i.e., the rear side surface and the front side surface).

By the above configuration, even in a case where a scratch or the like is unexpectedly caused on the engaging surface 81A when the guiding member 8 engages with the lower end portion of the second chute 55B via the engaging part 81, it is possible to stably guide the sheet S by the guide surface 81B without influencing the guide surface 81B.

The engaging part 81 has a claw shape in which the engaging surface 81A and the guide surface 81B intersect with each other at an angle, as seen from the right and left direction (the extension direction of the engaging part 81), and is formed so that an upper end portion of the guide surface 81B is inclined upward toward the engaging surface 81A.

Like this, in the illustrative embodiment, it is possible to form the guiding member 8 at low cost by the simple claw shape.

In the meantime, the coupling part 82 protrudes from a lower end portion of the engaging surface 81A of the engaging part 81.

The coupling part 82 has an L shape, for example, as seen from the right and left direction, and is configured by a first coupling member 82A extending in the front and rear direction and being coupled to the engaging part 81 at a front end portion thereof and a second coupling member 82B extending in the upper and lower direction and fixed to a rear end portion of the first coupling member 82A at an upper end portion thereof.

The coupling part 82 is rotatably supported by the sheet feeding tray 3 by a rotational shaft 82C.

When the coupling part 82 is rotated about the rotational shaft 82C, the engaging part 81 of the guiding member 8 engages with the lower end portion of the chute 55 (more specifically, the second chute 55B).

As a result, the guiding member 8 is operated to be displaceable between an engaging position (a position of the guiding member 8 shown in FIG. 6) at which the guiding member 8 restrains movement of the sheet feeding tray 3 and a separation position (a position of the guiding member 8 shown in FIG. 7) at which the engaging part 81 separates from the lower end portion of the chute 55 (the second chute 55B) and the guiding member 8 permits the movement of the sheet feeding tray 3.

Also, the guiding member 8 is configured to guide the sheet S that is fed from the sheet feeding tray 3 toward the chute 55 (the second chute 55B) via the guide surface 81B of the engaging part 81 at the engaging position.

By the above configuration, when the guiding member 8 is located at the engaging position, it is possible to prevent the sheet feeding tray 3 from being pulled out from the apparatus main body 2 while filling the step portion between the sheet feeding tray 3 and the chute 55 (the second chute 55B) of the apparatus main body 2-side by the guiding member 8.

That is, in order that the sheet feeding tray 3 can be detachably mounted to the apparatus main body 2, it is necessary to provide the step portion between the sheet feeding tray 3 and the chute 55 (the second chute 55B) of the apparatus main body 2-side. However, according to the image forming apparatus 1 of the illustrative embodiment, it is possible to provide both a lock function of restraining the movement of the sheet feeding tray 3 and a guide function of filling the step portion to guide the sheet by the guiding member 8.

Therefore, according to the image forming apparatus 1 of the illustrative embodiment, it is possible to prevent the sheet feeding tray 3 from being unexpectedly pulled out from the apparatus main body 2 while suppressing the hopping sound at the step portion between the sheet feeding tray 3 and the chute 55 (the second chute 55B) of the apparatus main body 2-side when conveying the sheet S.

Also, the guiding member 8 includes an urging member 83 formed by, for example, a tensile coil spring or the like, and configured to urge the guiding member 8 toward the engaging position.

By the above configuration, for example, even when a shock is unexpectedly applied to the image forming apparatus 1, it is possible to suppress the engaged state between the guiding member 8 and the lower end portion of the second chute 55B from being released.

In the meantime, the front face of the sheet feeding tray 3 is provided with a concave part 3A. When pulling out the sheet feeding tray 3 from the apparatus main body 2, it is possible to hold the sheet feeding tray 3 by gripping the concave part 3A. Also, the second coupling member 82B of the coupling part 82 of the guiding member 8 is disposed in the vicinity of the concave part 3A. When holding the sheet feeding tray 3 by gripping the concave part 3A, it is also possible to grip the second coupling member 82B at the same time.

By gripping the concave part 3A and the second coupling member 82B, the guiding member 8 is rotated about the rotational shaft 82C and is thus displaced to the separation position. That is, the sheet feeding tray 3 is permitted to move relative to the apparatus main body 2.

As described above, the sheet feeding tray 3 is provided with the gripping part 34 configured by the concave part 3A and the coupling part 82 (more specifically, the second coupling member 82B), and the sheet feeding tray 3 is pulled out from the apparatus main body 2 by gripping the gripping part 34.

In other words, the sheet feeding tray 3 has the gripping part 34 that is gripped when moving the sheet feeding tray 3 in the direction of pulling out the same from the apparatus main body 2. Also, the gripping part 34 has the coupling part 82 (the second coupling member 82B) which is coupled to the guiding member 8 (more specifically, the engaging part 81 that is a base part of the guiding member 8) and is configured to displace the guiding member 8 between the engaging position and the separation position in conjunction with a movement thereof.

By the above configuration, it is possible to move the guiding member 8 to the separation position in conjunction with the gripping of the gripping part 34 provided to the sheet feeding tray 3, thereby releasing the engaged state of the guiding member 8 with the lower end portion of the second chute 55B. Therefore, it is possible to easily perform the operation of moving the sheet feeding tray 3 relative to the apparatus main body 2.

In the meantime, the front face of the housing 21 configuring the apparatus main body 2 is provided with an inward guiding part 26 inclined downward toward the rear (i.e., the insertion direction of the sheet feeding tray 3) at the substantially same height position as the engaging part 81 of the guiding member 8 displaced to the engaging position.

When inserting the sheet feeding tray 3 into the apparatus main body 2, the engaging part 81 of the guiding member 8 is slid rearward at a posture rotated downward with being in contact with the inward guiding part 26. Thereby, the guiding member 8 is automatically displaced to the separation position.

As described above, the apparatus main body 2 has the inward guiding part 26 that comes into contact with the guiding member 8 and displaces the guiding member 8 to the separation position when moving the sheet feeding tray 3 in a direction of inserting the same into the apparatus main body 2 (i.e., in the rearward direction).

By the above configuration, even when inserting the sheet feeding tray 3 into the apparatus main body 2 without gripping the gripping part 34, the guiding member 8 is displaced to the separation position by the inward guiding part 26. Therefore, it is possible to smoothly perform the operation of mounting the sheet feeding tray 3 without any complicated operation.

<Effects of Illustrative Embodiment>

In the illustrative embodiment, the image forming apparatus 1 is configured as described above.

That is, the image forming apparatus 1 includes the sheet feeding tray 3 configured to support the sheet S that is to be fed, and the apparatus main body 2 configured to support the sheet feeding tray 3 so as to be moveable in a direction parallel with the sheet feeding direction of the sheet S.

The apparatus main body 2 includes the chute 55 configured to guide the sheet S that is fed from the sheet feeding tray 3. Also, the sheet feeding tray 3 includes the guiding member 8 configured to be displaced between the engaging position and the separation position, and configured to guide the sheet S that is fed from the sheet feeding tray 3 toward the chute 55 (more specifically, the second chute 55B of the apparatus main body 2-side) when the guiding member is located at the engaging position.

In the meantime, the engaging position is a position at which the guiding member engages with the chute 55 (the second chute 55B) and restrains the movement of the sheet feeding tray 3. Also, the separation position is a position at which the guiding member 8 separates from the chute 55 (the second chute 55B) and permits the movement of the sheet feeding tray 3.

By the above configuration, when the guiding member 8 is located at the engaging position, it is possible to prevent the sheet feeding tray 3 from being pulled out from the apparatus main body 2 while filling the step portion, which is formed between the sheet feeding tray 3 and the chute 55 (the second chute 55B) of the apparatus main body 2-side, by the guiding member 8.

Also, the sheet feeding tray 3 includes the gripping part 34 which is configured to be gripped when moving the sheet feeding tray 3 in the direction of pulling out the sheet feeding tray 3 from the apparatus main body 2, and the gripping part 34 includes the coupling part 82 which is coupled to the guiding member 8 (more specifically, the engaging part 81 that is a base part of the guiding member 8) and is configured to displace the guiding member 8 between the engaging position and the separation position in conjunction with a movement thereof.

By the above configuration, it is possible to move the guiding member 8 to the separation position in conjunction with the gripping of the gripping part 34 provided to the sheet feeding tray 3, thereby releasing the engaged state of the guiding member 8 with the lower end portion of the second chute 55B. Therefore, it is possible to easily perform the operation of moving the sheet feeding tray 3 relative to the apparatus main body 2.

Also, the guiding member 8 includes the engaging part 81 configured to engage with the chute 55 (more specifically, the second chute 55B of the apparatus main body 2-side), the engaging part 81 includes the engaging surface 81A configured to come into contact with the chute 55 (the second chute 55B) and the guide surface 81B configured to guide the sheet S that is fed from the sheet feeding tray 3, and the engaging surface 81A and the guide surface 81B are disposed in different regions.

By the above configuration, even in a case where a scratch or the like is unexpectedly caused on the engaging surface 81A when the guiding member 8 engages with the lower end portion of the second chute 55B via the engaging part 81, it does not influence the guide surface 81B. Therefore, it is possible to stably guide the sheet S by the guide surface 81B.

Also, the engaging part 81 has a claw shape in which the engaging surface 81A and the guide surface 81B intersect with each other at an angle.

By the above configuration, it is possible to form the guiding member 8 at low cost by the simple claw shape.

Also, the apparatus main body 2 includes the inward guiding part 26 that comes into contact with the guiding member 8 and displaces the guiding member 8 to the separation position when the sheet feeding tray 3 is moved in the direction of inserting the sheet feeding tray 3 into the apparatus main body 2.

By the above configuration, even when inserting the sheet feeding tray 3 into the apparatus main body 2 without gripping the gripping part 34, the guiding member 8 is displaced to the separation position by the inward guiding part 26. Therefore, it is possible to smoothly perform the operation of mounting the sheet feeding tray 3 without any complicated operation.

Also, the guiding member 8 includes the urging member 83 configured to urge the guiding member 8 toward the engaging position.

By the above configuration, for example, even when a shock is unexpectedly applied to the image forming apparatus 1, it is possible to suppress the engaged state between the guiding member 8 and the lower end portion of the second chute 55B from being released.

Also, the sheet feeding tray 3 includes the separation pad 31 configured to separate and feed the sheet S one by one, and the guiding member 8 is disposed downstream of the separation pad 31 with respect to the sheet feeding direction and is disposed so as to at least entirely overlap a region in the region in the direction perpendicular to the sheet feeding direction in which the separation pad 31 is provided.

By the above configuration, for example, even when the step portion of the chute 55 is configured so that it is inclined toward the downstream side of the sheet feeding direction as it is directed from both end portions of the sheet S in the width direction (the right and left direction) toward the central portion in the width direction, as disclosed in the related art, it is possible to further securely suppress the hopping sound that occurs when the rear end of the sheet S passes through the step portion.

What is claimed is:

1. An image forming apparatus comprising:

a sheet feeding tray configured to support a sheet that is to be fed; and an apparatus main body configured to support the sheet feeding tray so as to be moveable in a direction parallel with a sheet feeding direction of the sheet, the apparatus main body including a chute configured to guide the sheet that is fed from the sheet feeding tray, wherein the sheet feeding tray includes a guiding member configured to be displaced between an engaging position at which the guiding member engages with the chute and restrains movement of the sheet feeding tray and a separation position at which the guiding member separates from the chute and permits movement of the sheet feeding tray, and wherein the guiding member is configured to guide the sheet that is fed from the sheet feeding tray toward the chute when the guiding member is located at the engaging position.

2. The image forming apparatus according to claim 1, wherein the sheet feeding tray includes a gripping part which is configured to be gripped when moving the sheet feeding tray in a direction of pulling out the sheet feeding tray from the apparatus main body, and wherein the gripping part includes a coupling part which is coupled to the guiding member and is configured to displace the guiding member between the engaging position and the separation position in conjunction with a movement thereof.

3. The image forming apparatus according to claim 1, wherein the guiding member includes an engaging part configured to engage with the chute, wherein the engaging part includes:

an engaging surface configured to come into contact with the chute, and a guide surface configured to guide the sheet that is fed from the sheet feeding tray, and wherein the engaging surface and the guide surface are disposed in different regions.

4. The image forming apparatus according to claim 3, wherein the engaging part has a claw shape in which the engaging surface and the guide surface intersect with each other at an angle.

5. The image forming apparatus according to claim 1, wherein the apparatus main body includes an inward guiding part that comes into contact with the guiding member and displaces the guiding member to the separation position when the sheet feeding tray is moved in a direction of inserting the sheet feeding tray into the apparatus main body.

6. The image forming apparatus according to claim 1, wherein the guiding member includes an urging member configured to urge the guiding member toward the engaging position.

7. The image forming apparatus according to claim 1, wherein the sheet feeding tray includes a friction member configured to separate and feed the sheet one by one, and wherein the guiding member is disposed downstream of the friction member with respect to the sheet feeding direction and is disposed so as to at least entirely overlap a region in a direction perpendicular to the sheet feeding direction in which the friction member is provided.

* * * * *